US005484468A

United States Patent [19]

Östlund et al.

[11] Patent Number: 5,484,468

[45] Date of Patent: Jan. 16, 1996

[54] CEMENTED CARBIDE WITH BINDER PHASE ENRICHED SURFACE ZONE AND ENHANCED EDGE TOUGHNESS BEHAVIOR AND PROCESS FOR MAKING SAME

[75] Inventors: Åke Östlund, Täby; Ulf Oskarsson, Tumba; Per Gustafson, Huddinge; Leif Åkesson, Älvsjö, all of Sweden

[73] Assignee: Sandvik AB, Sandviken, Sweden

[21] Appl. No.: 192,628

[22] Filed: Feb. 7, 1994

[30] Foreign Application Priority Data

Feb. 5, 1993 [SE] Sweden ..... 9300376

[51] Int. Cl.[6] ..... C22C 29/02

[52] U.S. Cl. ..... 75/236; 419/18; 419/30; 419/34; 419/53

[58] Field of Search ..... 419/18, 30, 34, 419/53; 75/236

[56] References Cited

U.S. PATENT DOCUMENTS 4,277,283 7/1981 Tobioka et al. ..... 75/238
4,548,786 10/1985 Yohe ..... 419/29
4,610,931 9/1986 Nemeth et al. ..... 428/547
4,649,084 3/1987 Hale et al. ..... 428/552
4,830,930 5/1989 Taniguchi et al. ..... 428/547

FOREIGN PATENT DOCUMENTS 127416 1/1990 European Pat. Off. .

*Primary Examiner*—Donald P. Walsh
*Assistant Examiner*—Anthony R. Chi
*Attorney, Agent, or Firm*—Burns, Doane, Swecker & Mathis

[57] ABSTRACT

Cemented carbide inserts are available containing WC and cubic phases of carbide and/or carbonitride in a binder phase based on cobalt and/or nickel with a binder phase enriched surface zone. The binder phase content along a line essentially bisecting the rounded edge surfaces increases toward the edge and cubic phase is present. As a result, the edge toughness of the cutting inserts is improved.

16 Claims, 4 Drawing Sheets

CEMENTED CARBIDE WITH BINDER PHASE ENRICHED SURFACE ZONE AND ENHANCED EDGE TOUGHNESS BEHAVIOR AND PROCESS FOR MAKING SAME

BACKGROUND OF THE INVENTION

The present invention relates to coated cemented carbide inserts with a binder phase enriched surface zone and a process for the making of the same. More particularly, the present invention relates to coated inserts with enhanced properties in applications demanding high edge toughness.

Coated cemented carbide inserts with binder phase enriched surface zone are used today to a great extent for machining of steel and stainless materials. Thanks to the binder phase enriched surface zone, an extension of the application area for the cutting tool material is obtained.

Methods to make cemented carbide containing WC, cubic phase (gamma-phase) and binder phase with binder phase enriched surface zones are within the technique referred to as gradient sintering and are known through a number of patents and patent applications. According to U.S. Pat. Nos. 4,277,283 and 4,610,931, nitrogen containing additions are used and sintering takes place in vacuum whereas according to U.S. Pat. No. 4,548,786, the nitrogen is added in gas phase. In both cases a binder phase enriched surface zone essentially depleted of cubic phase is obtained. U.S. Pat. No. 4,830,930 describes a binder phase enrichment obtained through decarburization after the sintering whereby a binder phase enrichment is obtained which also contains cubic phase.

In U.S. Pat. No. 4,649,084, nitrogen gas is used in connection with the sintering in order to eliminate a process step and to improve the adhesion of a subsequently deposited oxide coating.

Gradient sintering of cemented carbide inserts according to known technique results, for essentially plane surfaces, in a binder phase enriched surface zone essentially free of cubic phase. In edges and corners, however, a complex superposition of this effect is obtained. The binder phase enriched surface zone in these parts of an insert is generally thinner and the content of cubic phase in a corner area is increased relative to that of an essentially plane surface with a corresponding decrease in binder phase content (FIG. 3). In addition, the cubic phase in said area is more coarse grained than in the interior of the insert (FIG. 1).

However, the edges of a cutting insert have to have a certain radius of the order of 50–100 μm or less in order to be useful. The edge radius is generally made after sintering by an edge rounding operation. In this operation, the thin outermost binder phase enriched zone is completely removed and the hard, brittle area is exposed. As a result, a hard but brittle edge is obtained. Inserts made by gradient sintering according to known technique therefore compared to 'straight', not gradient sintering processes pose an increased risk for brittleness problems in their edges, particularly in applications demanding high edge toughness.

This is particularly the case when sintering according to the teachings of, e.g., U.S. Pat. No. 4,610,931. Also, when using the technique disclosed in Swedish Patent Application no. 9200530-5, which corresponds to U.S. Ser. No. 08/019, 701, incorporated herein by reference, essentially the same situation occurs.

OBJECTS AND SUMMARY OF THE INVENTION

It is an object of this invention to avoid or alleviate the problems of the prior art.

It is further an object of this invention to provide coated cemented carbide inserts with a binder phase enriched surface zone and a process for the making of the same.

In one aspect of the invention there is provided a coated cemented carbide insert with rounded edge surfaces with improved edge toughness containing WC and cubic phases based on a metal carbide and/or carbonitride in a binder phase based on cobalt and/or nickel with a binder phase enriched surface zone essentially free of cubic phase wherein the binder phase content along a line essentially bisecting a rounded edge surface is greater near the edge than the nominal content of binder in the insert as a whole, decreases away from the edge and cubic phase is present along said line.

In another aspect of the invention there is provided a method of making a coated cemented carbide insert with improved edge toughness containing WC and cubic phases of a metal carbide and/or carbonitride in a binder phase based on cobalt and/or nickel with a binder phase enriched surface zone comprising said cemented carbide and thermally treating said sintered body, said treatment being started with a short nucleation treatment at increased nitrogen pressure, 300–1000 mbar, at a temperature between 1280° C. and 1450° C. followed by a period at a lower nitrogen pressure of 50– 300 mbar for 10–100 min whereafter the nitrogen gas is maintained to a temperature where the binder phase solidifies at 1265° C.–1300° C.

ER= solid line showing edge rounding after edge rounding treatment;

B= binder phase enriched surface zone; and

C= area enriched in cubic phase and depleted of binder phase. The area used for elemental analysis is indicated by two parallel lines $L_1$ and $L_2$.

Figure 2:
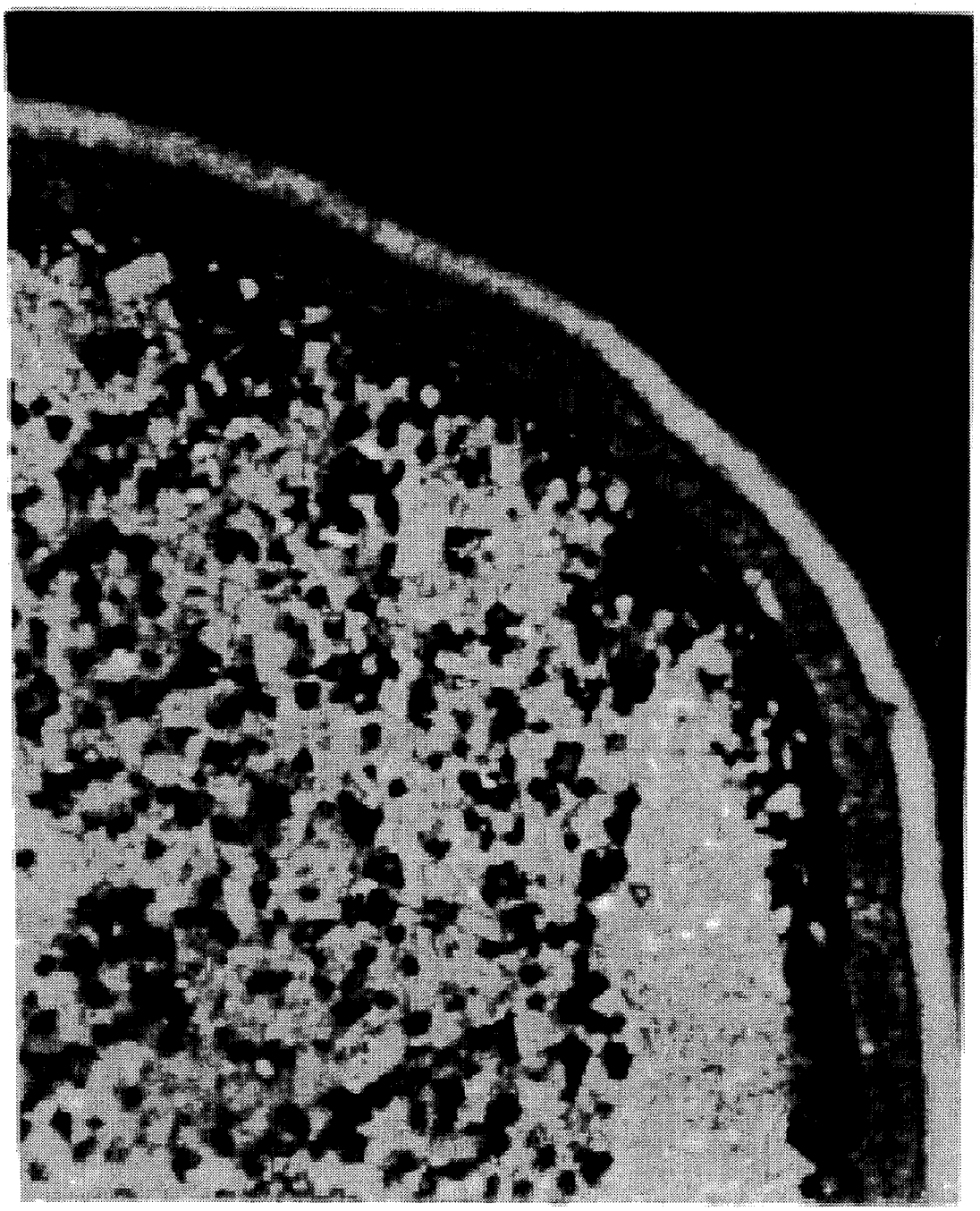

FIG. 2 is a light optical micrograph in 1000X of a crosssection of the edge of a cemented carbide insert according to the invention after edge rounding and coating.

Figure 1:
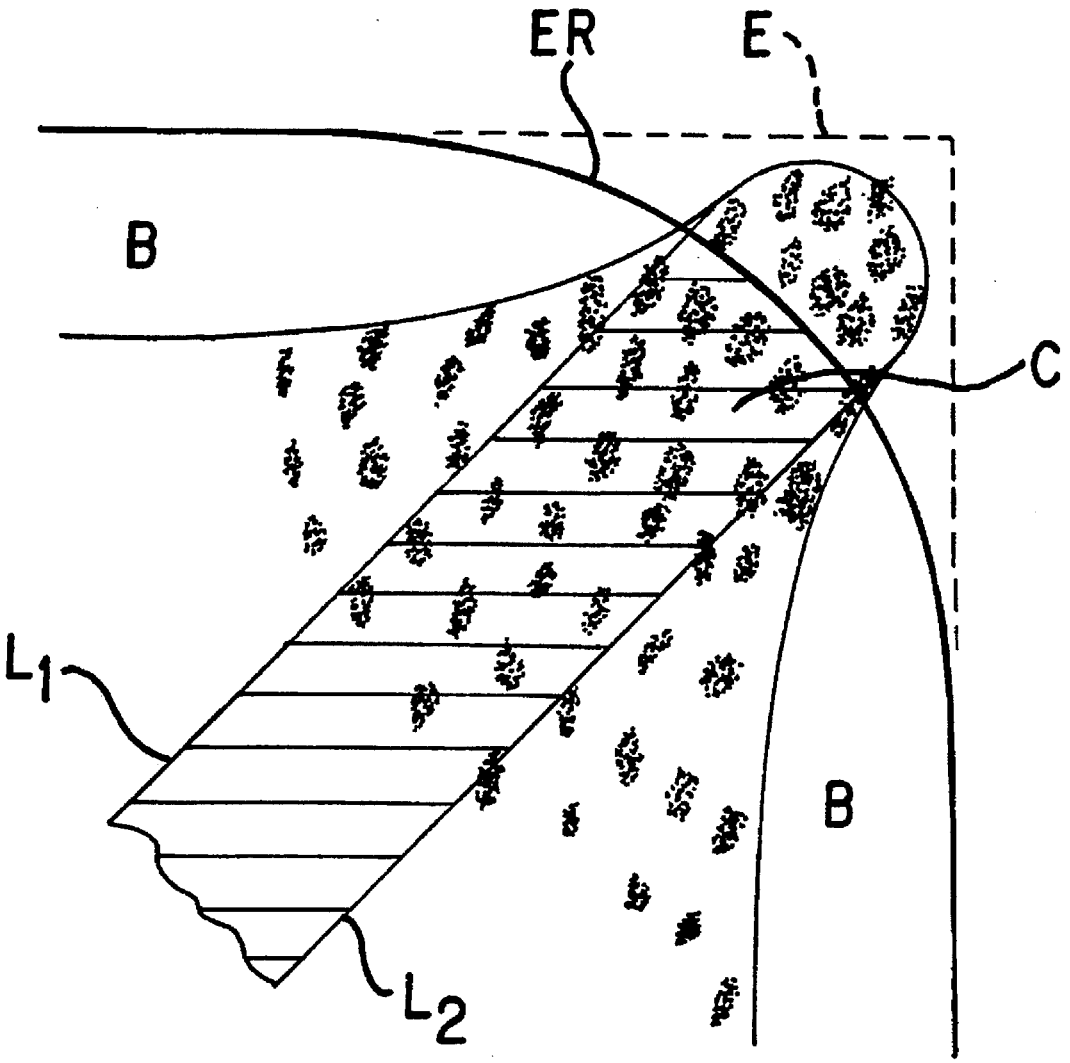
FIG. 1 is a schematic drawing of a cross-section of an edge of an insert gradient sintered according to known technique in which the solid dots represent cubic phase and E= dotted line showing the edge formed by the manufacturing process before the edge rounding treatment.
Figure 3:
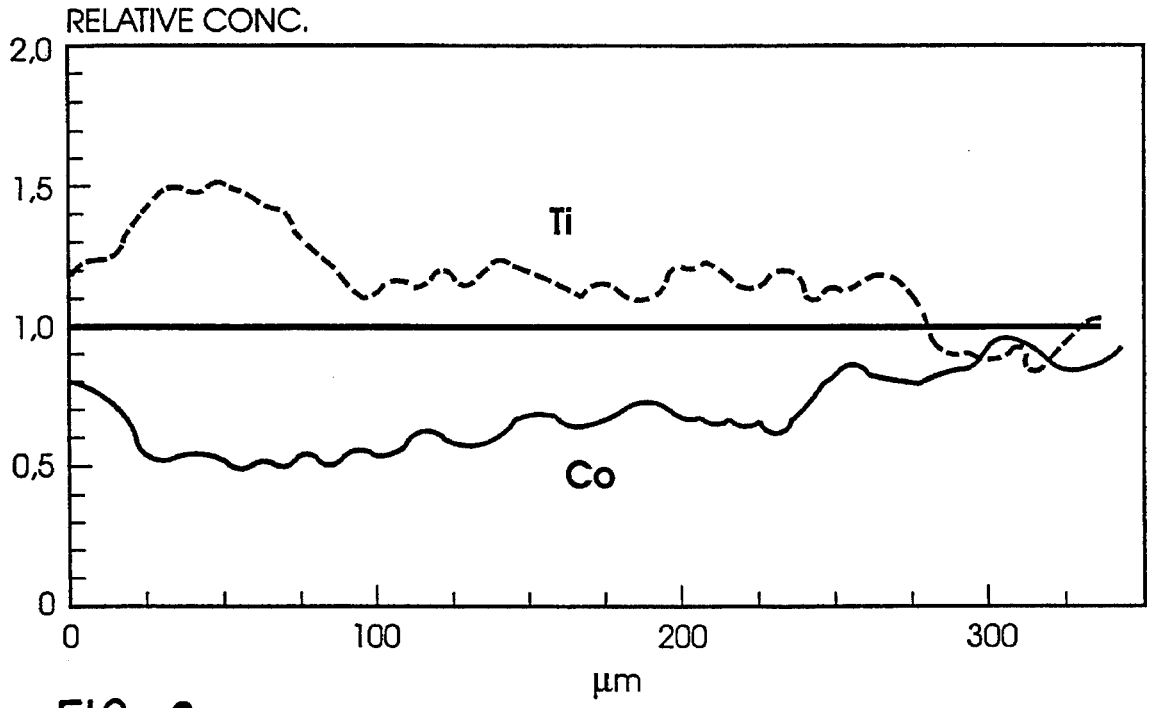

FIG. 3 shows the distribution of binder phase (Co) and cubic phase (Ti) as a function of the distance from the corner between the lines $L_1$ and $L_2$ as indicated in FIG. 1 essentially bisecting the edge in a binder phase enriched cemented carbide insert according to known technique.

Figure 4:
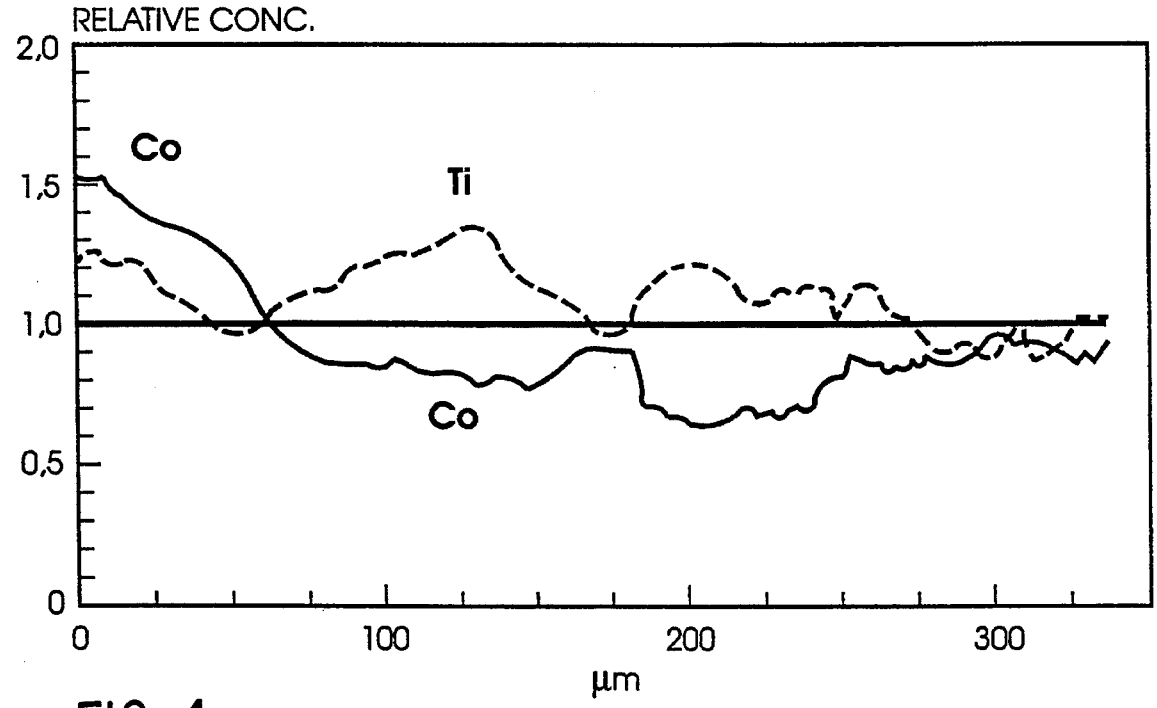

FIG. 4 shows the distribution of binder phase (Co) and cubic phase (Ti) as a function of the distance from the corner between the lines $L_1$ and $L_2$ as indicated in FIG. 1 essentially bisecting the edge in a binder phase enriched cemented carbide according to the invention.

Figure 5:
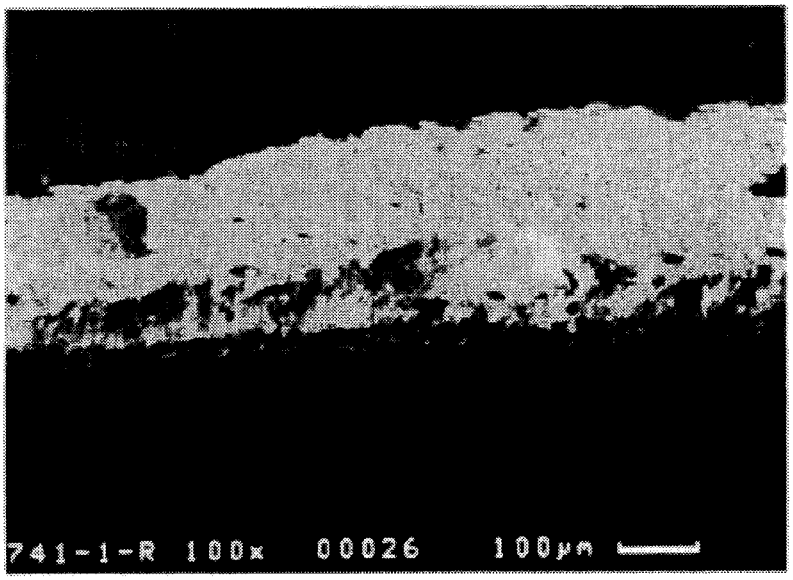

FIG. 5 is a scanning electron microscope image of an edge of a coated insert according to prior art used in a turning operation in stainless austenitic steel.

Figure 6:
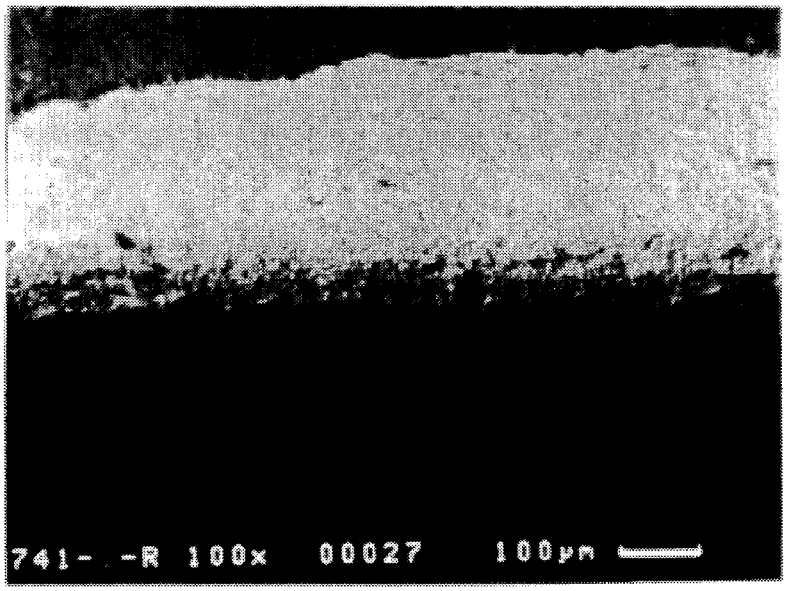

FIG. 6 is a scanning electron microscope image of an edge of a coated insert according to the invention used in a turning operation in stainless austenitic steel.

DETAILED DESCRIPTION OF THE PREFERRED EMBODIMENTS OF THE INVENTION

It has now turned out that if a vacuum sintered nitrogen containing cemented carbide insert with a binder phase enriched surface zone is subjected to a nitrogen 'shock' treatment at a temperature where the binder phase is liquid, the edge toughness can be increased considerably. The improvement is obtained at the same time as the resistance against plastic deformation remains essentially constant. The invention is particularly applicable to grades with relatively high content of cubic phase.

The present invention relates to a process step performed after conventional gradient sintering either as a separate process step or integrated into the gradient sintering. The process includes a nitrogen treatment in two steps. To ensure an abundant nucleation of cubic phase on the insert surface, the process is started with a short, <5 min, nucleation treatment at increased nitrogen pressure, 300–1000 mbar, at a temperature between 1280° C. and 1450° C., preferably at 300–600 mbar between 1320° C. and 1400° C. This treatment is followed by a growth period of the cubic phase at a lower nitrogen pressure optimal for the formation of an even surface layer of cubic carbide, 50–300 mbar for 10–100 min, preferably 100–200 mbar for 10–20 min. The nitrogen gas is maintained in this second step to a temperature where the binder phase solidifies at 1265° C.–1300° C.

The process according to the present invention is effective on a cemented carbide containing carbides of titanium, tantalum, niobium, tungsten, vanadium and/or molybdenum and a binder phase based on cobalt and/or nickel. An optimal combination of toughness and resistance against plastic deformation is obtained when the amount of cubic phase expressed as the total content of metallic elements forming cubic carbides, i.e., titanium, tantalum, niobium, etc., is between 6–18 weight %, preferably between 7–12 weight %, at a titanium content of 0.5–12 weight %, and when the binder phase content is between 3.5–12 weight %.

The carbon content is advantageously below carbon saturation since the presence of free carbon can result in precipitations of carbon in the binder phase enriched zone.

With the process according to the present invention, cemented carbide inserts are obtained with (compared to inserts made according to known techniques) improved edge toughness in combination with a high resistance against plastic deformation. The cemented carbide contains WC and cubic phases based on carbonitride and/or carbide, preferably containing titanium, in a binder phase based on cobalt and/or nickel with a generally <50 μm thick binder phase enriched surface zone essentially free of cubic phase, i.e., said surface zone contains mainly WC and binder phase. Due to the edge rounding, said binder phase enriched zone free of cubic phase is removed in the edge and the cubic phase extends to the rounded surface. The binder phase content along a line essentially bisecting the edge increases toward the edge for a distance of <200 μm, preferably <100 μm, most preferably <75 μm, from the outer rounded edge surface. That is, the binder phase content is highest near the edge and decreases along that line bisecting the outer rounded edge surface (see FIG. 4) and is higher near the edge than the nominal content of binder phase in the insert as a whole. The average binder phase content in the outermost 25 μm thick surface zone is >1, preferably 1.05–2, most preferably 1.25–1.75, of the binder phase content in the inner of the insert. The outer surface of the binder phase enriched surface zone is, except for an area about <30 μm on each side of the edge, because of the edge rounding, essentially covered by a <5 μm, preferably 0.5–3 μm, thin layer of cubic phase. FIG. 2 shows the microstructure of an edge according to the present invention and FIG. 4 shows the distribution of binder phase and cubic phase as a function of the distance from the corner along a line essentially bisecting the rounded edge surface.

Cemented carbide inserts according to the present invention after the edge rounding operation may be suitably coated within and of themselves known thin wear resistant coating, e.g., TiC, TiN and $Al_2O_3$, by CVD- or PVD-techniques in accordance with the knowledge of the skilled artisan. Preferably in such instances, a layer of metal carbide, nitride or carbonitride, preferably of titanium, is applied as the innermost layer.

Inserts according to the present invention are particularly suited in applications demanding high edge toughness such as turning and milling of stainless steel, nodular cast iron and low alloyed low carbon steel.

The invention is additionally illustrated in connection with the following Examples which are to be considered as illustrative of the present invention. It should be understood, however, that the invention is not limited to the specific details of the Examples.

EXAMPLE 1

From a powder mixture comprising 1.9 weight % TiC, 1.4 weight % TiCN, 3.3 weight % TaC, 2.2 weight % NbC, 6.5 weight % cobalt and rest WC with 0.15 weight % overstoichiometric carbon content, turning inserts CNMG 120408 were pressed. The inserts were sintered according to standard practice in $H_2$ up to 450° C. for dewaxing and further in vacuum to 1350° C. and after that with protective gas of Ar for 1 h at 1450° C.

During the cooling, a treatment according to the invention was made. After cooling to 1380° C. and evacuation of the protective Ar gas, 600 mbar $N_2$ was supplied and maintained for 1 min after which the pressure was lowered to 150 mbar and kept constant for 20 min. The cooling was continued under the same atmosphere down to 1200° C., where evacuation and refilling of Ar took place.

The structure in the surface of the cutting insert consisted then of a 25 μm thick binder phase enriched zone essentially free from cubic phase. In the area below the cutting edge, a zone had formed where the binder phase content is increased with about 30% relative compared to nominal content. This area extended from 20 μm from the surface to 100 μm. In the outermost part of the cutting edge there was an enrichment of coarse cubic phase particles with core-rim structure which essentially were removed at the comers during the subsequent edge rounding treatment. Herewith, the binder phase enriched area was exposed.

EXAMPLE 2

(reference Example to Example 1 )

From the same powder as in Example 1 inserts of the same type were pressed and sintered according to the standard part of the sintering in Example 1, i.e., with a protective gas of Ar during the holding time at 1450° C. The cooling was under a protective gas of Ar without any heat treatment.

The structure in the surface consisted as in Example 1 of a 25 μm thick binder phase enriched surface zone essentially free from cubic phase. In the edge area, however, the binder phase enriched area was missing. Instead, the corresponding area was depleted of binder phase with about 30% relative to nominal content. The fraction of cubic phase was correspondingly higher. During the subsequent edge rounding treatment, the binder phase depleted and cubic phase enriched area was exposed. This is a typical structure for gradient sintered cemented carbide according to known techniques.

EXAMPLE 3

With the CNMG 120408 inserts from Examples 1 and 2, a test was performed as an interrupted turning operation in a quenched and tempered steel, SS2244. The following cutting data were used:

Speed= 100 m/rain
Feed= 0.15 mm/rev
Cutting depth= 2.0 mm 30 edges of each insert were run until fracture. The average tool life for the inserts according to the present invention was 7.3 min and for the inserts according to known technique, 1.4 min.

EXAMPLE 4

The inserts from Examples 1 and 2 were tested in a continuous turning operation in a quenched and tempered steel with the hardness HB= 280. The following cutting data were used:

Speed= 250 m/min
Feed= 0.25 mm/rev
Cutting depth= 2.0 mm

The operation led to a plastic deformation of the cutting edge which could be observed as a wear land on the clearance face of the insert. The time to obtain a wear land width of 0.40 mm was measured for five edges each. Inserts according to the present invention obtained an average tool life of 10.0 min and according to known technique an average tool life of 11.2 min.

From Examples 3 and 4, it is evident that inserts according to the present invention show a considerably better toughness behavior than according to known technique without having significantly reduced their plastic deformation resistance.

EXAMPLE 5

With inserts from Examples 1 and 2, a tool life test in austenitic stainless steel (SS2333) was performed. The test consists of repeated facing of a thick walled tube (external diameter 90 mm and internal diameter 65 mm). The following data were used:

Speed= 150 m/min
Feed= 0.36 mm/rev
Cutting depth= 0-3-0 mm (varying)

The test was run until maximum flank wear= 0.80 mm or until fracture. As an average for five edges the following results were obtained.

Prior art= 11 cuts, 5 out of 5 edges fractured.

According to the invention= 51 cuts, 0 out of 5 edges fractured.

EXAMPLE 6

With inserts from Examples 1 and 2, a test of the initial wear was performed in austenitic stainless steel (SS2333). The tests consists of facing of a thick walled tube (external diameter 90 mm and internal diameter 50 mm). The following data were used:

Speed= 140 m/min
Feed= 0.36 mm/rev
Cutting depth= 0-3-0 mm (varying)

The result after one cut is evaluated by studying in a scanning electron microscope the initial wear on the edge after etching away the adhering work piece material. The prior art insert had small chipping damages, FIG. 5, whereas the inserts according to the invention had no such chippings, FIG. 6.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A coated cemented carbide insert with rounded edge surfaces with improved edge toughness containing WC and cubic phases based on a metal carbide and/or carbonitride in a binder phase based on cobalt and/or nickel with a binder phase enriched surface zone essentially free of cubic phase wherein the binder phase content along a line essentially bisecting a rounded edge surface is greater near the edge than the nominal content of binder in the insert as a whole, decreases away from the edge, cubic phase is present along said line and the binder phase content in the outermost 25 μm thick surface zone is >1 of the binder phase content in the inner of the insert.

2. The coated cemented carbide insert of claim 1 wherein the binder phase content in the outermost 25 μm thick surface zone is 1.05–2 of the binder phase content in the inner of the insert.

3. The coated cemented carbide insert of claim 1 wherein said higher binder phase content continues to a distance of < 200 μm from the outer surface.

4. The coated cemented carbide insert of claim 3 wherein said higher binder phase content continues to a distance of < 100 μm from the outer surface.

5. The coated cemented carbide insert of claim 3 wherein said higher binder phase content continues to a distance of <75 μm from the outer surface.

6. The coated cemented carbide insert of claim 1 wherein the insert has an innermost <5 μm thick layer of cubic phase except in the rounded edge surfaces on the surface of the binder phase enriched surface zone.

7. The coated cemented carbide insert of claim 6 wherein the insert has an innermost 0.5–3 μm thick layer of cubic phase except in the rounded edge surfaces on the surface of the binder phase enriched surface zone.

8. The coated cemented carbide insert of claim 1 wherein said insert is coated with a wear resistant layer.

9. The coated cemented carbide insert of claim 8 wherein said wear resistant coating comprises TiC, TiN or $Al_2O_3$.

10. The coated cemented carbide insert of claim 9 wherein a layer of metal carbide, nitride or carbonitride is applied between said cemented carbide insert and said wear resistant coating.

11. The coated cemented carbide insert of claim 10 wherein the metal of said layer comprises titanium.

12. A method of making a coated cemented carbide insert with improved edge toughness containing WC and cubic phases of a metal carbide and/or carbonitride in a binder phase based on cobalt and/or nickel with a binder phase enriched surface zone comprising said cemented carbide and thermally treating said sintered body, said treatment being started with a short nucleation treatment at increased nitrogen pressure, 300–1000 mbar, at a temperature between 1280° C. and 1450° C. carded out for <5 minutes followed by a period at a lower nitrogen pressure of 50–300 mbar for 10–100 min whereafter the nitrogen gas is maintained to a temperature where the binder phase solidifies at 1265° C.–1300° C.

13. The method of claim 12 wherein said thermally treated body is then coated with a wear resistant coating.

14. The method of claim 13 wherein said wear resistant coating comprises TiC, TiN or $Al_2O_3$.

15. The method of claim 14 wherein a layer of metal carbide, nitride or carbonitride is applied between said cemented carbide insert and said wear resistant coating.

16. The method of claim 15 wherein the metal of said layer comprises titanium.

* * * * *